US005997278A

United States Patent [19]

Sutton

[11] Patent Number: 5,997,278

[45] Date of Patent: Dec. 7, 1999

[54] APPARATUS FOR PROVIDING AN AIR/FUEL MIXTURE TO A FULLY PREMIXED BURNER

[75] Inventor: David Michael Sutton, Camberley, United Kingdom

[73] Assignee: BG plc, Berkshire, United Kingdom

[21] Appl. No.: 08/913,544

[22] PCT Filed: Feb. 14, 1996

[86] PCT No.: PCT/GB96/00353

§ 371 Date: Nov. 20, 1997

§ 102(e) Date: Nov. 20, 1997

[87] PCT Pub. No.: WO96/25628

PCT Pub. Date: Aug. 22, 1996

[30] Foreign Application Priority Data

Feb. 16, 1995 [GB] United Kingdom ..... 9503065

[51] Int. Cl.[6] ..... F23N 11/44; F23N 5/00

[52] U.S. Cl. ..... 431/12; 431/90; 431/76; 431/77; 236/15 BD; 236/15 E

[58] Field of Search ..... 431/12, 89, 90, 431/76, 77; 236/15 BD, 15 BR, 15 E; 110/185, 186

[56] References Cited

U.S. PATENT DOCUMENTS

| | | | |
|---|---|---|---|
| 4,330,260 | 5/1982 | Jorgensen et al. | 431/76 |
| 4,396,369 | 8/1983 | Kaessmann | 431/76 |
| 4,545,009 | 10/1985 | Muraki et al. | 431/76 |
| 4,585,161 | 4/1986 | Kusama et al. | 431/12 |
| 4,927,351 | 5/1990 | Hagar et al. | 431/12 |
| 4,994,959 | 2/1991 | Ovenden et al. | 431/12 |
| 5,401,162 | 3/1995 | Bonne | 431/89 |
| 5,630,408 | 5/1997 | Versluis | 431/90 |

*Primary Examiner*—Ira S. Lazarus
*Assistant Examiner*—Josiah C. Cocks
*Attorney, Agent, or Firm*—William H. Holt

[57] ABSTRACT

Apparatus provides an air/fuel mixture to a fully premixed burner and comprises means for providing fuel at a variable flow rate to the burner, means for supplying air at a variable flow rate to the fuel to form the mixture, means for sensing aeration of the fuel combustion products and control means for controlling the fuel flow rate in dependence upon a heat output demand and the air flow rate in dependence upon both the fuel flow rate and the sensed aeration in such a way that the air flow rate is sufficient to maintain the aeration at a predetermined value, the controller, in use, maintaining the fuel flow rate at one of a number of predetermined values and the air flow rate at a corresponding one of a number of differing predetermined values, each set of predetermined values being characterized by a constant value of the ratio between successive values.

10 Claims, 2 Drawing Sheets

APPARATUS FOR PROVIDING AN AIR/FUEL MIXTURE TO A FULLY PREMIXED BURNER

The present invention relates to apparatus for providing an air/fuel mixture for example to fuel cell, but particularly an air/fuel gas mixture to a fully premixed burner.

BACKGROUND OF THE INVENTION

In such a burner fuel gas is mixed, before combustion in the burner, with air in a plenum chamber.

The fuel gas is usually supplied from a main while the air is supplied by a fan.

To prevent incomplete combustion of the gas and the production of poisonous carbon monoxide gas, the volume flow rate of air is usually intended to be maintained in excess of the rate theoretically necessary for full combustion of the gas. Typically this excess amounts to 30%, and the burner is then said to be operating with 130% of the stoichiometric air requirement or, for brevity, "at 130% aeration".

SUMMARY OF THE INVENTION

According to the present invention apparatus for providing an air/fuel mixture to a fully premixed burner comprises means for providing fuel at a variable flow rate to the burner, means for supplying air at a variable flow rate for mixing with the fuel in a plenum chamber within the burner, means for sensing aeration by measuring the composition of the combustion products and control means for controlling the fuel flow rate in dependence upon a heat output demand and the air flow rate in dependence upon both the fuel flow rate and the sensed aeration in such a way that the air flow rate is sufficient to maintain the aeration at a predetermined value, the values of fuel flow rate and air flow rate being particular values within a respective range of predetermined values which form a geometric series with a constant ratio between successive terms.

The means for providing fuel at a variable rate may comprise a modulating valve having a variable opening to vary the fuel gas flow rate, while the means for supplying air at a variable rate may comprise either a variable speed fan or alternatively a variable throttle valve in association with a fan operating at a nominally constant speed.

The means for sensing aeration may comprise a sensor for sensing the oxygen content of the fuel combustion products and for providing a signal representative of the oxygen content.

Conveniently the geometric series contains a predetermined number $N_{max}$ of terms, each term being in accordance with the following relationship:

$$Q_N = Q_1 \times R^{(N-1)}$$

where:

$Q_N$ is the respective fuel flow rate or air flow rate at the $N_{th}$ step in the predetermined series of steps, $Q_1$ is the respective fuel flow rate or air flow rate at step one in the series and therefore for both the fuel flow rate and the air flow rate constitutes the respective lowest of the permitted rates of flow, R is a constant term equal to the common ratio of the geometric series, the value of R being chosen according to the resolution desired between successive steps in flow rate and being furthermore the same for the respective series defining the permitted rates of flow of fuel gas and of air, and N is a number uniquely identifying any individual step and having a lowermost value of unity and an uppermost value of $N_{max}$, the latter being determined jointly by the chosen value of the constant R and the ratio of magnitude between the highest and lowest rates of flow to be provided.

Suitably the constant R is allocated a value of 1.025.

This apparatus can satisfy a variable heat demand largely without on-off cycling of the burner yet with accurate control of the burner aeration.

The advantage of making changes on the basis of a geometric series of flowrate values is that it becomes possible to make adjustments to the parameters which control the process of combustion, as percentage changes in the existing values of the parameter(s).

DETAILED DESCRIPTION OF THE INVENTION

Figure 1:
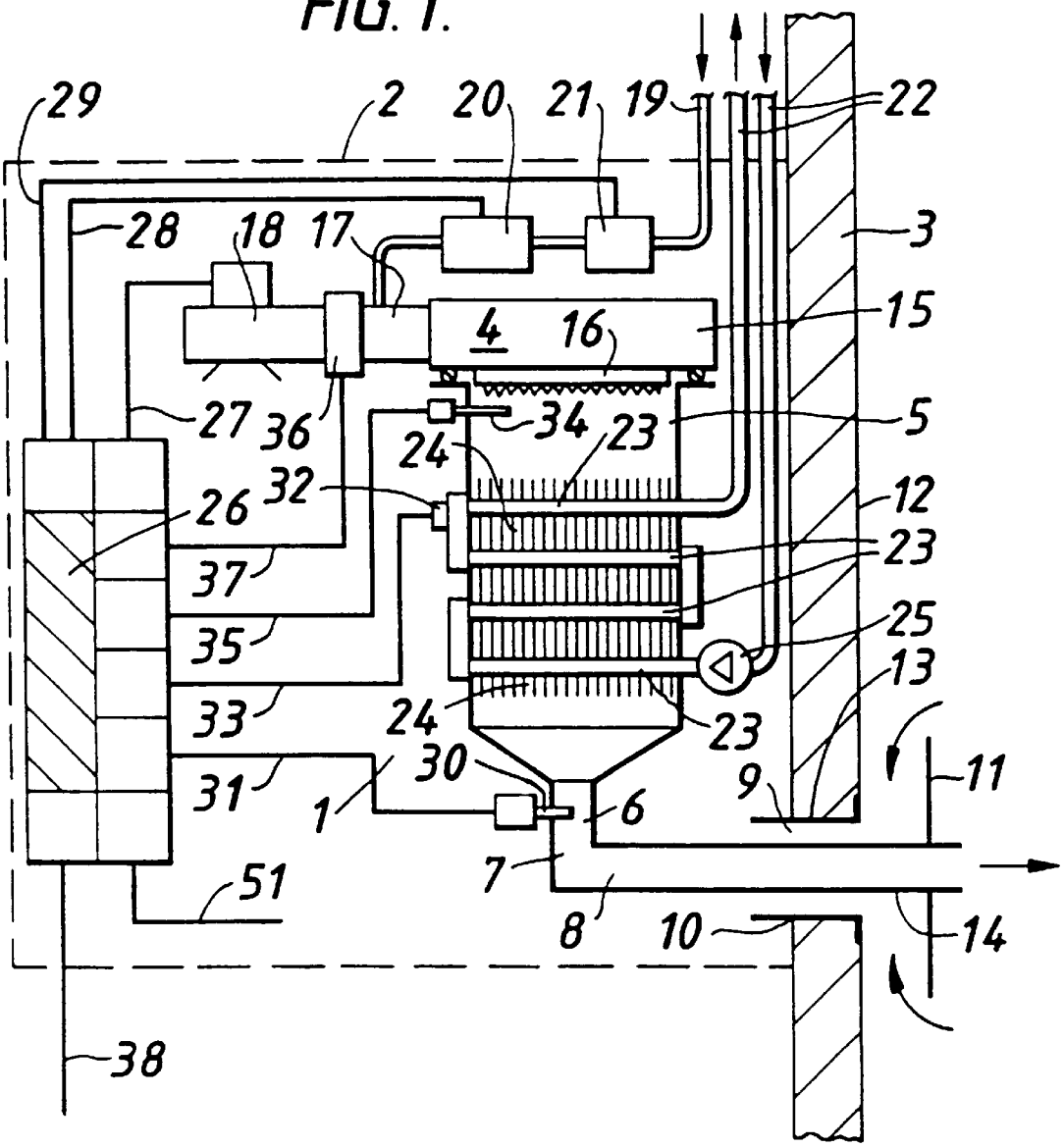
FIG. 1 is a schematic view of a domestic combustion system in a gas-fired domestic heating appliance, together with control apparatus therefor.

Referring to FIG. 1, there is illustrated a domestic combustion system which comprises a gas boiler 1 located within a room-sealed casing 2 mounted on the inner surface of an outside wall 3 of a dwelling. The boiler 1 includes a fully-premixed gas burner 4 mounted on and sealed to an enclosure 5, the gas burner being designed to fire downwardly into an uppermost part of the enclosure 5 which forms a combustion chamber.

The enclosure 5 terminates in a lowermost flue 6 which has a vertical part 7 immediately beneath the enclosure and a horizontal part 8 connected to the vertical part 7 and extending with a clearance 9 through a hole in the wall 3. The clearance 9 is formed by the horizontal part of a flanged outlet 10. The horizontal part 8 of the flue has a circumferential flange 11 spaced from the outer surface 12 of the wall 3. The flange 11 forms with a flanged guard 13 in the wall surrounding the clearance 9 and the outer surface 14 of the horizontal flue part 8 an air intake of the so-called "balanced flue" variety.

The burner 4 has a plenum chamber 15 beneath which is located the burner plate 16. Upstream from the plenum chamber 15 is a mixing chamber 17 where the air and fuel gas meet and mix before combustion.

Air for the burner 4 is provided by a variable-speed fan 18 connected to the mixing chamber 17. Fuel gas for the burner 4 is supplied by a gas supply pipe 19 which connects to the mixing chamber 17. The gas is supplied from a pressurised main in a conventional manner but the gas flow rate is controlled by a modulating gas valve 20 located in the gas line and shut-off gas valve 21. The modulating gas valve 20 has an opening area which is variable to provide variation in the flow rate of the fuel gas.

Pipework 22 is provided to supply cold water to and remove heated water from the boiler 1, a portion 23 of the piping 22 being in serpentine form and located mainly in the enclosure 5 to enable the water to be heated by the combustion products, the part 23 having finning 24 to improve heat exchange between the combustion gases and the water. Water is pumped through parts 22, 23 and around a hot water and central heating system (not shown) by a water pump 25.

The combustion system is controlled by a control means or controller in the form of a microelectronic control box 26. This controls the fan 18 via a line 27, the gas modulating valve 20 via a line 28 and the gas shut-off valve 21 via a line 29.

An oxygen-detecting combustion sensor 30 is located in the vertical part 7 of the flue 6. The sensor 30 forms part of a so called "closed-loop" system for air/gas ratio control, supplying to the control box 26 via a line 31 an output voltage signal, the magnitude of which is directly related to the oxygen concentration in the flue gas and therefore, to the aeration in the combustible air/gas mixture, since air is admitted into the enclosure 5 only through the burner plate 16, as a constituent of the mixture produced in the chamber 17.

A hot water temperature sensor 32 located on an external part of the pipe portion 23 delivers a voltage signal to the control box 26 via a line 33. If the water temperature is excessive, the controller 26 will close the valves 20, 21 via the lines 28, 29 respectively, preventing further operation of the burner 4 until the water temperature has fallen to some lower value.

A combined igniter and flame failure detector 34, located immediately beneath the burner plate 16, communicates bi-directionally with the control box 26 by means of a line 35. The device 34 is a standard feature forming no part of the present invention, it being mentioned for completeness only.

Between the fan 18 and the mixing chamber 17 there is mounted a differential-pressure-sensing assembly 36 comprising a diaphragm-operated switch fitted with changeover contacts and an orifice plate through which the air flow for combustion passes, consequently falling in pressure by an amount related in a predictable manner to the rate of air flow. The diaphragm is located within a chamber which is thereby divided into two compartments, each of which is connected to a different side of the orifice plate, but is otherwise sealed. The diameter of the diaphragm is chosen to be such that the moving finger of the switch (not shown) will disengage from the zero-pressure (or "rest") contact and engage the pressure contact when the pressure difference across the diaphragm rises to a chosen magnitude; and the diameter of the orifice is selected so that this magnitude will be attained at some predetermined rate of air flow, under some particular set of operating conditions. The switch when activated at the predetermined air flow rate delivered by the fan 18 supplies a signal along line 37 to the control box 26 for purposes to be subsequently described.

Figure 2:
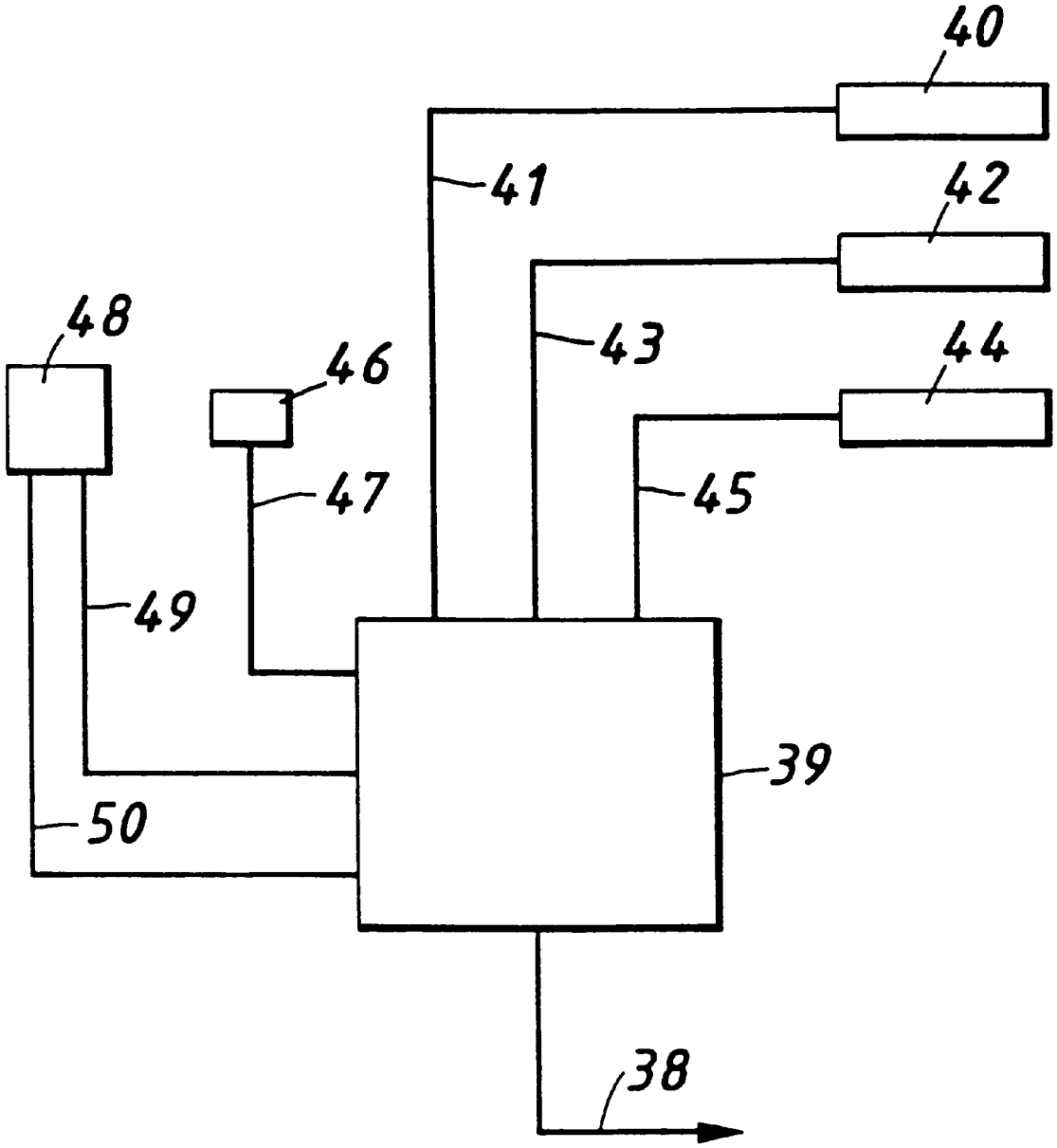
FIG. 2 is a schematic circuit diagram illustrating how the heat demand signal is produced.

A signal indicative of the demand for heat is supplied to the control box 26 along line 38 from a demand signal processor 39, the connections to which are shown schematically in FIG. 2. The processor 39 receives signals from a room temperature sensor 40 along line 41, a hot water temperature sensor 42 along line 43, a boiler water temperature sensor 44 along line 45, a hot water cylinder thermostat 46 along line 47 and a central heating/hot water programmer 48 along the lines 49 and 50.

From the various signals received the processor 39 computes an appropriate heat demand signal for transmission to the controller 26 along line 38. The processor 39 may be an essentially conventional device: it forms no intrinsic part of the present invention.

In the present embodiment, the variable-speed fan 18 is an off-the-shelf item incorporating a brushless direct current motor and a sensor for supplying to the control box 26 signal pulses proportional in frequency to the rotational speed of the fan 18. The control box 26 supplies power and a control signal to the motor and receives pulses from the speed sensor, all via the multicore line 31. The control signal is supplied as a train of rectangular pulses of 1000 Hz frequency generated by the control box 26, the duration $L_{cp}$ of each 0–5 V pulse of the train being variable by the control box 26 over the range 0.0000–0.0010 second to control the speed of the fan 18. The time interval between successive pulses from the speed sensor is measured by the control box 26, translated into a rotational speed in revolutions per minute and encoded. This value is then compared with a series of similarly encoded reference values held in ROM in the control box 26, and any difference existing between the sampled and any selected one of the reference values is reduced to zero by adjustment of the duration of the control pulses supplied to the motor of the fan 18. In this way the control 26 is able to obtain and maintain the fan speed corresponding to the selected reference value. In a combustion system of the type shown in FIG. 1, if other factors remain constant, the rate of air flow is very nearly proportional to the rotational speed of the fan. Therefore, provided that the performance of the fan is sufficient under the given conditions, the control box 26 will be able to procure, very nearly, any one of a selection of alternative air flow rates by adjusting the duration $L_{cp}$ of the control pulses so as to equalise the corresponding reference fan speed value and the actual fan speed value implied by the signal from the sensor on the fan 18.

Referring to Table 1, this illustrates schematically the first 12 rows of a data look-up table which is stored in ROM in the control box 26.

The first column of the table comprises "N", the step number representing the number of a term in the geometric series which forms the basis of flow control in the present invention as described above.

The second column in the table comprises the respective gas flow rate G in cubic meters/hour ($m^3$/h) corresponding to each particular step number N. The steps shown cover a range of gas flow rates between a minimum of 0.35 $m^3$/hr and 0.46 $m^3$/hr at step N=12. The flow rate at each step is approximately 2.5% greater than that at the preceding step, reflecting the intended value (1.025) of the common ratio of the geometric series.

The third column in the table comprises the respective fan speed F in revolutions per minute (rev/min) corresponding to each value of N in column 1 of the look-up table. The steps shown cover fan speeds ranging from 1050 rev/min at N=1 to 1378 rev/min at N=12. The flow rate at each step is approximately 2.5% greater than that at the preceding step.

The fourth column in the table comprises the respective drive voltage Vmgv in volts, corresponding to each value of N in the table, for operating the modulating valve 20.

The fifth column in the table comprises the nominal duration of the fan speed control pulses in microseconds corresponding to each value of N, as supplied on line 27.

The sixth column in the table comprises the minimum allowable value of the output voltage $(V^*_{cs})_L$ from the oxygen sensor 30 at any particular N value and the seventh column in the table comprises the maximum allowable value of output voltage $(V^*_{cs})_U$ from the sensor 30 at any particular N value.

In constructing such a table, each combination of gas flow rate and fan speed is selected to provide a predetermined air/gas flow rate ratio corresponding to an intended percentage aeration of the combustible mixture, given fuel gas of an assumed theoretical air requirement for combustion ($m^3$air/$m^3$ fuel gas) and a fan of assumed performance characteristics operating normally in a combustion system of an assumed flow resistance characteristic. To secure the maximum possible performance from the combustion system, the intended percentage aeration may be made variable according to the rate of gas flow. In that case, the output voltage values in columns 6 and 7 of Table 1 would vary accordingly with the step number N. As Table 1 indicates, however, this refinement has not been adopted in the present embodiment. We describe later methods of compensating for departures from the circumstances assumed in constructing the data look-up table, so that the concentration of oxygen in the vicinity of the sensor 30 and so, the percentage aeration of the combustible mixture, may remain as intended.

For ease of explanation, the data in Table 1 are shown as ordinary numbers. In reality, however, all tabular data are stored in digital form, in keeping with normal practice. In particular, the gas flow rates in Column 2 are stored as digital voltages representative of these gas flow rates on the basis of a fixed scaling factor. It will be appreciated that columns 3 and 5 may contain entries up to a value of $N_{max}$ higher than that to which entries in columns 2 and 4 extend.

The program followed by the control box 26 in the present embodiment will now be described in outline.

A key to all the symbols used in the description is shown in Table 2.

The program starts by resetting to zero in RAM, for later program purposes, two parameters $C_{FS}$ and M, described below. It then reads the line 38, to find whether there exists on the line a voltage at least equal to a preset value $V_{min}$. If such a voltage is present, this indicates the existance of a demand for heat from the external source 39, as explained above. In that case, the control box 26 will carry out routine safety checks as in known combustion controllers. If these indicate danger, a value of zero will be stored into RAM for a signpost variable S and all further action will be suspended in a state of "lockout" until the user directs the program back to its startpoint by pressing a conventional "reset" switch on the control box 26, this also causing the program to change the value of S to unity.

If the safety checks reveal no hazard, the control box 26 will find from ROM the value of $(N_{CO})^*$, a reference step number denoting a fan speed assumed sufficient for actuation of the changeover switch in the assembly 36 when the lookup table was constructed. The control box 26 will then generate and supply along the line 27 a train of fan speed control pulses as described earlier, the duration $L_{cp}$ of these pulses being that listed in Column 5 of the look-up table, in the row for $N=(N_{co})^*$. When the speed of the fan 18 has become steady, the control box 26 will determine whether a voltage exists at the pressure contact of the changeover switch in the assembly 36. If there is none, the value of $L_{cp}$ in relation to the maximum value of 0.0010 second is checked; and as $L_{cp}$ will not be at the maximum value at this stage, the control box 26 will increase $L_{cp}$, pause suitably for a change in fan speed to occur and re-examine the pressure contact of the changeover switch. This will continue until either a voltage appears at this contact, or the value of $L_{cp}$ becomes 0.0010 second. In the latter event, in the interest of safety, the control box 26 will set S=O, $L_{cp}$=O and "lockout", as described above.

In the alternative event, however, the control box 26 will measure the value of $L_{cp}$ and find from the look-up table the associated nominal step number $(N_{cp})_{CO}$. This number is then stored into RAM for convenience if more than one attempt to light the burner should prove necessary, or if the flame should become extinguished at some time after the burner has come into operation. The control box 26 will then relocate the existing stored value of the parameter $C_{FS}$ to a different address as the parameter $(C_{FS})_E$, measure the fan speed F, and find from the look-up table , and store into RAM, the corresponding step number $N=N_{CO}$. It will next look-up the value of $(N_{CO})^*$ and evaluate the flow switch fan speed correction factor $C_{FS}$ from the Equation:

$$C_{FS}=N_{CO}-(N_{CO})^* \quad (1)$$

The factor $C_{FS}$ will be stored into RAM for use later, as will be described. If the circumstances of operation happened to accord exactly with those assumed in constructing the look-up table, $C_{FS}$ would be zero.

The control box 26 will now estimate the difference $[C_{FS}]$ between this new and the previous value of $C_{FS}$. As the latter was set to zero at the startpoint of the program, $[C_{FS}]$ will be non-zero. This condition will cause the program to reset to zero in RAM the value of a parameter $C_{CL}$, the "closed-loop" fan speed correction factor defined by Equation 7 below.

After a pause of $t_p$ seconds during which fresh air is blown through the combustion system to purge it of residual products from previous combustion and of any traces of fuel gas which may have leaked in through the closed valve 21, the control box 26 will estimate, and store into RAM, the fan speed step number for ignition $N=N_i$, given by the generalised Equation:

$$N_i=1+C_{FS}+C_{CL}+B \quad (2)$$

where $C_{CL}$="closed-loop" fan speed correction factor, stored in RAM and defined below.

B=fuel variability index, employed when the difference $[C_{FS}]$ is non-zero.

The index B is a constant preset in the program of the control box 26, during manufacture or installation of the heating equipment. The value of the constant reflects the degree of variation expected in the properties of the fuel gas to be used by the burner 4. If no significant variation is expected, the index B would be preset to zero.

The control box 26 will now lookup in the table the nominal value of $L_{cp}$ for the step number $N=N_i$ and supply pulses of this duration on the line 27. Next it will measure the steady fan speed F resulting in due course and again consult the look-up table to find the corresponding step number $N=N_F$. If $N_F$ differs from $N_i$, the duration of the control pulses will be altered and the process repeated until the difference is removed. This being achieved, the control box 26 will cease to adjust $L_{cp}$, measure the value arrived at and find from the look-up table, and store into RAM, the corresponding step number $N=(N_{cp})_i$. It will then energise firstly the igniter of the device 34 and, a few seconds later, the coil of the gas shutoff valve 21, enabling fuel gas to flow to the burner 4 through the modulating valve 20 which, through unenergised at this stage, sits in a partially-open position against an internal stop. If after a time $t_i$ seconds no flame is sensed by the detector of the device 34, the control box 26 will turn off the power supply to the igniter and to the valve 21.

Next the control box 26 will recall from RAM the value of I, an ignition attempt index which may be allocated a value of zero or unity by the program, as circumstances require. In the present instance, as no previous attempt at ignition had been made the stored value of I will be zero, so the program will update I to unity and try again to establish a flame on the burner 4. To do so it will recall from RAM the step number $N=(N_{cp})_{CO}$, lookup the corresponding value of $L_{cp}$, supply control pulses of this duration and repeat the steps described above in relation to the initial attempt at ignition. In the course of this, the parameters $N_{CO}$, $(N_{cp})_{CO}$ and $C_{FS}$ will be revised if necessary, or alternatively, the control box 26 will establish "lockout" in the manner described above if the control pulse duration should rise to its maximum value of 0.0010 second without a voltage appearing at the pressure contact of the changeover switch. If a flame fails to appear on the second attempt, since now I=1 the control box 26 will set S=O, $L_{cp}$=O and then "lockout". If flame is established in either attempt, however, the igniter will be de-energised and a value I=O will be stored into RAM.

For safety, the control box 26 will now check whether, with the igniter off, a flame remains present at the detector of the device 34. If it does not, one attempt will be made to relight the flame. To do this the control box 26 will turn off the power supply to the valve 21, store a value I=1 into RAM and go through the remainder of the procedure described above for a second ignition attempt.

If flame does exist at the detector, the control box 26 will read the line 38, to establish whether there is still a demand for heat. If, unusually, there is no longer any demand, the control box will turn off the supply of power to the valve 21, set $L_{cp}$=O to stop the fan and await the emergence of a new demand for heat. If, however, the demand still exists, the control box 26 will carry out certain standard safety checks. Should these reveal some hazard, the program will set S=O, de-energise the valve 21, set $L_{cp}$=O and go to "lockout".

Assuming for the present purpose that the safety checks are completed successfully, however, the control box 30 will examine the value of the parameter M. When the program of the control box 30 has come into operation from its start-point, the value of M will be zero. In this event the program will store into RAM a tentative value of unity for the parameter $N_G$, defined below.

Next the control box 30 will extract from RAM the existing value of $N'_G$, restore it into RAM at a different address with the reference $(N'_G)_E$, and set out to establish the step number $N=N'_G$ corresponding most nearly to the actual demand for heat from the external source 39.

To do this, the control box 26 will first measure and scale the voltage signal on the line 38, on the assumption that the calorific value of the fuel gas is at the value assumed in constructing the look-up table. Should this assumption be invalid in a particular case, the temperature sensors connected to the external source 39 will discern this in due course as a shortfall, or alternatively an excess, in a desired temperature in the fluid (water or room air) being heated, and the source 39 will then alter the voltage signal on the line 38 in a sense which will tend to remove the temperature discrepancy. The scaled voltage is encoded and compared with the series of encoded voltages stored in Column 2 of the look-up table and representative of rates of gas flow through the modulating gas valve 20. This comparison will identify the entry in the table most nearly suitable, on the basis of the assumed calorific value, to meet the particular demand for heat. Therefrom the control box 26 will identify from Column 1 of the same table, and store tentatively into RAM, the corresponding number $N'_G$ for setting the drive voltage $V_{mgv}$ for the modulating valve 20.

At this point the value of the parameter M will again be examined. Should M=O, the program of the control box 30 will store into RAM a value of unity for the parameter $N''_G$ representing the working value of the step number controlling the drive voltage for the valve 20. In either case, the control box 30 will then determine whether the step numbers $N'_G$ and $(N'_G)_E$ are equal. If they are, the program will immediately enter the "closed-loop" phase of operation since no adjustment to the drive voltage for the valve 20 or, by implication, to the speed of the fan 18 is necessary in the "open-loop" mode.

If $N'_G$ and $(N'_G)_E$ are not equal, however, the control box 30 will examine the value of M for the last time. Should it be zero, the program will store into RAM a value M=1 and proceed to the "closed-loop" phase of operation. Otherwise, the control box 30 will establish whether the requested value $N'_G$ is permissible. To do so, it will recall from RAM the current values of the control pulse step number and the fan speed step number (in the general case, referenced respectively as $N_{cp}$ and $(N''_A)$ and restore them into RAM at new addresses reference respectively as $(N_{cp})_E$, $(N''_A)_E$. Recalling $(N_{cp})_E$ and $(N''_A)_E$ the control box 26 will use Equation (3) below to define an uppermost limiting step number $(N'_G)_P$ for controlling the valve 20:

$$(N'_G)_P=N_{max}-[(N_{cp})_E-(N''_A)_E]-C_{FS}-C_{CL}-B \quad (3)$$

where $N_{max}$ is the maximum step number stored in the look-up table.

In the particular case where the burner has just come into operation, the parameters $(N_{cp})_E$ and $(N''_A)_E$ will take the values $(N_{cp})_i$ and $N_i$ respectively.

Provided $N'_G$ does not exceed the limiting value $(N'_G)_P$, the control box 26 will adopt the value $N'_G$ without modification; otherwise the lesser value $(N'_G)_P$ will be adopted instead. In either event the adopted value will be stored into RAM as the step number $N''_G$ to be used for setting the valve 20.

Having so identified $N''_G$, the control box 26 will estimate and store into RAM a corresponding new step number $N''_A$ for controlling the speed of the fan 18, using the Equation:

$$N''_A=N''_G+C_{FS}+C_{CL}+B \quad (4)$$

Recalling from RAM the values of $N''_A$, $(N_{cp})_E$ and $(N''_A)_E$, the control box 26 will estimate, and store into RAM, a target control pulse step number $N_{cp}$ given by Equation (5):

$$N_{cp}=(N''_A-(N''_A)_E)+(N_{cp})_E \quad (5)$$

The control box 26 will now compare the target and existing values of $N_{cp}$ to determine the required direction of change in the step number. In the present instance, as the burner is operating at its minimum rate and assuming that the existing and adopted values of $N''_G$ are unequal, by implication an increase in burner heat output is called for. The control box 26 will therefore increment by a number of steps the pulse duration $L_{cp}$, and then by the same number of steps (after a pause to allow the change in fan speed to come partially into being), the drive voltage $V_{mgv}$ for the valve 20 to a value corresponding to a step number $N_G$. It will then note this step number $N_G$ temporarily controlling the gas flow rate, compare this with the target value $N''_G$ and continue the change process until the respective target step numbers $N_{cp}$ and $N''_G$ are arrived at simultaneously. This stepwise procedure serves to limit any transitory reduction in the air/gas flow rate ratio which would arise if the modulating valve 20 responded more quickly than the fan 18 to a given change in the step number. After every stage of change in the settings of the fan 18 and modulating valve 20, the control box 26 will check that the flame has not become extinguished.

Next the control box 26 will measure the actual fan speed F, find the corresponding step number $N=N_F$ and estimate the difference $[N]_1=(N''_A-N_F)$. Normally these step numbers will be equal, so that their difference will be zero and the program will proceed to the starting point of the "closed-loop" operating mode. However if $N_F$ is found to exceed $N''_A$, the control box 26 will recall the control pulse step number $N_{cp}$, reduce it by the amount of the difference and store this new value of $N_{cp}$ into RAM. The control box 26 will then lookup, and provide, the corresponding new pulse duration $L_{cp}$, measure the resulting fan speed when this has become steady, identify the value of $N_F$ and evaluate the new difference $(N''_A-N_F)$. If, exceptionally, an inequality persists, the procedure described will be repeated until $N_F$ has become equal to $N''_A$.

If, on the contrary, $N_F$ is found to be less than $N''_A$, the control box 26 will recall $N_{cp}$, find from the look-up table the value of $N_{max}$ estimate the difference $[N]_2=(N_{max}-N_{cp})$ and evaluate the Equation:

$$E=(N_{max}-N_{cp})-(N''_A-N_F)=[N]_2-[N]_1 \quad (6)$$

where

E=excess of step numbers remaining if the shortfall $(N''_A-N_F)$ were made good only by upward adjustment of $N_F$.

If E is not less than zero, the control box 26 will estimate a new value of the parameter $N_{cp}=[N''_A-N_F)]$ and store this value into RAM. It will then identify from the look-up table the corresponding value of the control pulse duration $L_{cp}$ and generate and despatch along the line 27 pulses of this duration to increase the speed of the fan 18. The control box 26 will again measure the fan speed when this has become steady, identify the new value of $N_F$ and repeat the process if, exeptionally, this proves necessary, so that $N_F$ may become equal to $N''_A$.

Should E be less than zero, however, the control box 26 will first recall and revise $N''_G$ to a new value reduced by the amount E, store the revised value into RAM and identify from the look-up table, and set, the corresponding value of $V_{mgv}$, to lessen the rate of fuel gas flow. Secondly, it will estimate using Equation (4), and store into RAM, a new value of the target fan speed step number $N''_A$ suitable for the revised value of $N''_G$; and thirdly, it will set $L_{cp}$ to the maximum value of 0.0010 second and store into RAM the corresponding step number $N_{cp}=N_{max}$. Next the control box 26 will again measure the steady fan speed F, identify from the look-up table the corresponding value of $N_F$, recall the reduced value of $N''_A$ and estimate the new difference $(N''_A-N_F)$. Should (in exceptional circumstances) $N_F$ still be less than $N''_A$, the control box 26 will apply a further reduction in $N''_G$ amounting to the shortfall $(N''_A-N_F)$, the control pulse duration remaining at 0.0010 second. This will ensure that $N_F$ will become equal to $N''_A$. The control box 26 will store this latest value of $N''_G$ into RAM and use it as the working value from which to identify and set the drive voltage $V_{mgv}$ for the modulating valve 20.

With the intended flow rate ratio attained under "open-loop" conditions, the program of the control box 26 will start the timer for the "closed-loop" control phase and then pause for a period of t* seconds, during which routine safety checks will be performed while conditions stabilise at the combustion sensor 30. If no hazard is detected in this process, and if the demand for heat persists, at the end of the time t* the control box 26 will sample and encode the voltage $V_{cs}$ on the line 31 and compare the result with the encoded reference voltages $(V^*_{cs})_L$, $(V^*_{cs})_U$ in Columns 6 and 7 respectively of the look-up table, in the row for the working value $N=N''_G$. Three alternative possibilities arise.

If the voltage on the line 31 is found to be less than the lower of the two stored reference voltages, this means that the air/gas flow rate ratio is less than is appropriate. In that case the control box 26 will recall $N_{cp}$, lookup the value of $N_{max}$ and estimate the difference $[N]_2=(N_{max}-N_{cp})$. If this is at least two, the control box 26 will estimate and store into RAM a new value of the parameter $N_{cp}=(N_{cp}+2)$, identify from the look-up table the corresponding value of the control pulse duration $L_{cp}$ and generate and despatch along the line 27 pulses of this duration, to increase the speed of the fan 18. If $(N_{max}-N_{cp})$ is less than two, however, the control box 26 will recall and revise $N''_G$ to a new value reduced by two, store this into RAM and identify from the look-up table, and set, the corresponding value of $V_{mgv}$ so to lessen the rate of gas flow, the value of $L_{cp}$ remaining unchanged. In either case, after a further settling time t* has elapsed without any hazard arising, the control box 26 will again sample and encode the voltage on the line 31 from the combustion sensor 30 and compare the result with the reference voltages stored in Columns 6 and 7 of the look-up table, in the row for the operative setting $N=N''_G$. If the sampled voltage is still less than the lower of the two stored reference voltages, the control box 26 will repeat the above procedure until the sampled voltage on the line 31 assumes a value which is either equal to the lower of the two reference voltages, or is between these voltages.

As the second possibility, if when sampled and encoded the voltage on the line 31 is found to be greater than the higher of the two stored voltages, this implies that the air/gas flow rate ratio is greater than is appropriate. In this case the control box 26 will recall the existing control pulse step number $N_{cp}$ from RAM and establish whether its value is less than three.

If it is not, the control box 26 will estimate a new value $N_{cp}=(N_{cp}-2)$ and store this into RAM. From the look-up table the control box will identify the corresponding value of $L_{cp}$, and it will then generate and despatch along the line 27 control pulses of this duration, to decrease the speed of the fan 18. When a settling time t* has elapsed without any unsafe condition emerging, the control box 26 will again sample and encode the voltage on the line 31 from the combustion sensor 30 and compare the result with the reference voltages stored in Columns 6 and 7 of the look-up table, in the row for $N=N''_G$. If the sampled voltage is still greater than the higher of the two stored reference Voltages, the control box 26 will extract the altered value of $N_{cp}$ from RAM and repeat the procedure described, until either the value of $N_{cp}$ becomes less than three or alternatively, the sampled voltage on the line 31 assumes a value which is equal to the higher of the two reference voltages, or lies between these voltages.

If the value of $N_{cp}$ is or becomes less than three, the control box 26 will recall the parameter $N''^G$ from RAM and estimate, and store into RAM, an altered value $N''_G=(N''_G+2)$. It will then find from the look-up table, and set, the corresponding value of the drive voltge $V_{mgv}$ for the modulating valve 20, the value of $L_{cp}$ remaining unchanged. After a settling time t* has elapsed in safety, the control box 26 will again sample and encode the voltage on the line 31 from the combustion sensor 30 and compare the result with the reference voltages stored in Columns 6 and 7 of the look-up table, in the row for the increased value $N=N_G$. If the sampled voltage is still greater than the higher of the two stored reference voltages, the control box 26 will extract the altered value of $N''_G$ from RAM and repeat the procedure described, until the sampled voltage on the line 31 assumes a value which is equal to the higher of the two reference voltages, or lies between these voltages.

If the value of the voltage on the line 31 is found to lie anywhere within the range bounded by the pair of reference voltages, the control box 26 will apply no adjustment to the air/gas flow rate ratio set in the "open-loop" mode.

If, in any of the above circumstances, the sampled voltage on the line 31 fails to enter the intended range within a preset time t (for example, 60 seconds) from the start of "closed-loop" operation, the control box 26 will shut the combustion system down in "lockout" until the user has pressed the "reset" switch to return the program to its startpoint. Normally, however, the sampled voltage on the line 31 will be, or will quickly become, equal to one of the two reference voltages, or to a voltage intermediate therebetween. When this occurs the control box 26 will stop the "closed-loop" timer, measure the time interval between successive pulses from the speed sensor on the fan 18 and estimate and encode the actual fan speed F. This will now be compared with the encoded values in Column 3 of the look-up table, and the step number $(N_F)_{CL}$ corresponding to the nearest value listed will be stored into RAM. Finally, recalling $(N_F)_{CL}$, $N''_G$ and $C_{FS}$ from RAM, the control box 26** will evaluate and store into RAM, for use in later "open-loop" phases of operation, an updated "closed-loop" fan speed correction factor $C_{CL}$ given by the relationship:

$$C_{CL}=(N_F)_{CL}-N''_G-C_{FS} \tag{7}$$

Having completed "closed-loop" operation, the program of the control box 26 will return to the point, described earlier, where it established whether flame continued to be present at the detector of the device 34 after the igniter had been switched off. From there all the foregoing steps will then be performed again in the manner described.

Should the safety checks at this point show that the demand for heat has ceased, or that the temperature at the sensor 32 on the pipe portion 23 has become excessive, the program of the control box 26 will turn off the power supply to the gas shutoff valve 21, set the parameters $V_{mgv}$ and $L_{cp}$ both to zero to extinguish the flame and go to "standby", awaiting a fresh demand for heat from the source 39.

On receiving this, the control box 26 will once again go through the procedure for burner startup described earlier, and in so doing will re-evaluate the factor $C_{FS}$. The new value of $C_{FS}$ will be stored into RAM, not in replacement of the previous value but at a separate address, as explained earlier. The control box 26 will now estimate the difference $[C_{FS}]$ between the new and the previous value; and should this not be zero, a value of zero for the "closed-loop" factor $C_{CL}$ will be stored into RAM, in replacement of the value of $C_{CL}$ stored previously. The revised values of $C_{FS}$ and $C_{CL}$ will be adopted along with the value of the index B when Equations (2) to (4) are next employed. By this means the control system can take account, prior to igniting the burner, of changing operating conditions (including potential variations in fuel gas properties) but avoid the prospect of overcompensating in the "open-loop" mode for any persisting change in the fan performance or in the system flow resistance characteristic which may have taken place during an immediately prior period of operation of the burner 4, and which will have been corrected at that time in the "closed-loop" mode by a suitable change in the factor $C_{CL}$.

By later adjusting $L_{cp}$, and/or if need be $V_{mgv}$, according to the magnitude of the sampled voltage on the line 31, the control box 26 is able to modify the air/gas flow rate ratio set previously in the "open-loop" mode, when this is necessary to maintain the desired concentration of oxygen in the vicinity of the sensor 30. Such action would be needed if the theoretical air requirement of the fuel gas should differ from the figure assumed in constructing the look-up table or in allocating the value of the index B; or again, if either the performance of the fan 18 or the flow resistance characteristic of the combustion system should alter, in a long period of uninterrupted operation of the burner 4, from that which was reflected in the value of the correction factor $C_{FS}$ established during the startup process.

Importantly, because according to the present invention any flow rate ratio adjustment made in the "closed-loop" mode is, in continuous operation, automatically taken into account, via the recalculated factor $C_{CL}$, in the next "open-loop" portion of the control cycle, a flow rate ratio set "open-loop" will usually require little amendment in the following "closed-loop" phase. Consequently, despite changes in flow resistance, fan performance and fuel gas properties, the burner 4 will function for almost all of its working time at a percentage aeration close to, or identical with, that intended by the designer. This will minimise the generation of undesireable by-products of the combustion process, and maximise the life of the burner and the performance of the equipment which it serves.

Further, although with fuel gas of the assumed calorific value there will be some reduction in heat service if the final setting $N''_G$ is less than the requested setting $N'_G$, from the standpoint of the user the approach in the present invention is more advantageous than the conventional philosophy. In the latter, operation of the burner 4 would be prevented altogether if, at a predetermined nominal fan speed, the fan 18 became unable to support, at an intended air/gas flow rate ratio, the maximum rate of fuel gas flow which the valve 20 had been factory-set to allow. Such failure would typically be indicated by the non-appearance of a voltage at the pressure contact of a changeover switch such as that in the assembly 36.

It will be appreciated that in practice most operations in the control of heating and combustion involve responding to, or making, percentage changes in variables, rather than absolute-magnitude changes. For such a purpose a geometric-series-based control scheme is ideally suitable, since a geometric series is characterised by a fixed ratio between successive terms in the series; in other words, there is a fixed percentage difference between such terms. Therefore to make, for instance, an increase of X% in a variable, it will be necessary to advance through the series by roughly (X/100r) terms, where r is the percentage difference between successive terms of the series; or to be exact, by a number of terms C given by the formula:

$$C=\frac{\text{Log}\,(1+X/100)}{\text{Log}\,R} \tag{8}$$

where

R is the common ratio of the geometric series.

Log denotes the logarithm of the quantities shown, to any desired base.

The percentage change X may, of course, be negative in value, in which case the quantity C will define the number of terms to be traversed from the existing term back towards the beginning of the series.

The number C may therefore be viewed as an algebraically additive correction factor to the term denoting the existing magnitude in which the change of X% is to be made. This is the principle underlying the use of Equations (1) to (7) above. By this approach, estimation operations which are in essence multiplicative are transformed into additive operations, which are simpler to perform in conjunction with data from look-up tables. The necessary calculation operations can be carried out with a much lower memory capacity than would be required if, for example, an arithmetic series were used as the basis of control. This saves cost without compromising the flexibility and resolution of the control system.

In reality the choice of X is confined to values resulting from integer values of C, as non-integer values of C would have no practical meaning. By adopting a sufficiently small value for the common ratio R, the degree of resolution between the values of the controlled variable corresponding to successive terms can be made as fine as may be desired or necessary or useful in view of limitations set by imperfections in the control hardware.

TABLE 1

| (1) N | (2) G ($m^3/h$) | (3) F (rev/min) | (4) $V_{mgv}$ (volts) | (5) $L_{cp}$ ($\mu$sec) | (6) $(V^*_{cs})_L$ (volts) | (7) $(V^*_{cs})_U$ (volts) |
|---|---|---|---|---|---|---|
| 1 | 0.35 | 1050 | 0.00 | 23 | 0.86 | 0.94 |
| 2 | 0.36 | 1076 | 0.54 | 25 | 0.86 | 0.94 |
| 3 | 0.37 | 1103 | 1.09 | 27 | 0.86 | 0.94 |
| 4 | 0.38 | 1131 | 1.66 | 29 | 0.86 | 0.94 |
| 5 | 0.39 | 1159 | 2.24 | 31 | 0.86 | 0.94 |
| 6 | 0.40 | 1188 | 2.83 | 33 | 0.86 | 0.94 |
| 7 | 0.41 | 1218 | 3.20 | 36 | 0.86 | 0.94 |
| 8 | 0.42 | 1248 | 3.39 | 39 | 0.86 | 0.94 |
| 9 | 0.43 | 1279 | 3.60 | 41 | 0.86 | 0.94 |
| 10 | 0.44 | 1311 | 3.81 | 45 | 0.86 | 0.94 |
| 11 | 0.45 | 1344 | 4.02 | 48 | 0.86 | 0.94 |
| 12 | 0.46 | 1378 | 4.24 | 52 | 0.86 | 0.94 |

TABLE 2

| Key to Symbols | |
|---|---|
| B | Fuel variability factor preset in value during manufacture or installation of the control box. |
| C | Number of terms to be traversed to make a change of X % in a variable controlled in accordance with a geometric series. |
| $C_{CL}$ | Updated value of the "closed-loop" fan speed correction factor, defined by Equ. 7. |
| $C_{FS}$ | Updated value of the flow switch fan speed correction factor, defined by Equ. 1. |
| $(C_{FS})_E$ | Existing stored (prior) value of the flow switch fan speed correction factor. |
| $[C_{FS}]$ | Difference between the updated value and the prior value of the flow switch fan speed correction factor. |
| E | Excess of step numbers, defined by Equ. 6. |
| F | Actual fan speed (rev/min). |
| I | Ignition attempt number, having a value of 0 or 1. |
| $L_{cp}$ | Duration of the fan speed control pulses supplied on the line 27. |
| M | Program control marker variable, having a value of 0 or 1. |
| $[N]_1$ | Difference ($N''_A - N_F$) between the desired and the actual fan speed step number. |
| $[N]_2$ | Difference ($N_{max} - N_{cp}$) between the maximum step number value stored in the look-up table and the step number in use for setting the duration of the fan speed control pulses. |
| $N''_A$ | Step number corresponding to the desired fan speed, defined by Equ. 4. |
| $(N''_A)_E$ | Existing stored (prior) value of the desired fan speed step number. |
| $N_{CO}$ | Step number corresponding to the fan speed at which a voltage appears at the pressure contact of the switch in the assembly 36. |
| $N_{CO})^*$ | Normally sufficient (reference) value of $N_{CO}$. |
| $N_{cp}$ | Step number used for setting the duration of the fan speed control pulses. |
| $(N_{cp})_{CO}$ | Step number controlling the duration of the fan speed control pulses when the fan speed step number $N_{CO}$ is achieved. |
| $(N_{cp})_E$ | Existing stored (prior) value of the step number for setting the duration of the fan speed control pulses. |
| $(N_{cp})_i$ | Step number regulating the duration of the fan speed control pulses when the actual fan speed corresponds to the step number $N_i$. |
| $N_F$ | Step number corresponding to an actual fan speed F. |
| $(N_F)_{CL}$ | Fan speed step number on completion of "closed-loop" control action. |
| $N_G$ | Step number regulating the drive voltage for the valve 20 to a fixed value temporarily, while the fan speed is altered during a change in burner heat output. |
| $N'_G$ | Step number corresponding most nearly to the demand for heat. |
| $(N'_G)_E$ | Existing stored (prior) value of the step number $N'_G$. |
| $(N'_G)_P$ | Maximum permissible step number for regulating the valve 20, defined by Equ. 3. |
| N"G | Adopted value of step number far regulating the valve 20. |
| $N_i$ | Fan speed step number desired for burner ignition, defined by Equ. 2. |
| $N_{max}$ | Maximum step number value stored in the look-up table. |
| r | Percentage difference between successive terms in a geometric series. |
| R | Common ratio of a geometric series. |
| S | Signpost variable routing the program to "standby" or to "lockout", dependent upon whether its value is 1 or 0 respectively. |
| $t_i$ | Maximum permitted delay in establishing flame during the ignition process. |
| $t_p$ | Required purge time during the ignition process. |
| t* | Time allowed for the environment at the combustion sensor 30 to stabilise in composition, following an adjustment in the rate of air and/or fuel gas flow. |
| t** | Maximum permitted time for completion of "closed-loop" action. |
| $V_{cs}$ | Output voltage provided by combustion sensor 30. |
| $(V^*_{cs})_L$ | Minimum allowable value of output voltage from sensor 30. |
| $(V^*_{cs})_U$ | Maximum allowable value of output voltage from sensor 30. |
| $V_{mgv}$ | Drive voltage for modulating gas valve 20. |
| $V_{min}$ | Minimum value of output voltage from external source 39, indicative of a demand for heat. |
| X | Percentage change in a variable. |

I claim:

1. Apparatus for providing an air/fuel mixture to a fully premixed burner comprising means for providing fuel at a variable flow rate to the burner, means for supplying air at a variable flow rate to the fuel to form the mixture, means for sensing aeration of fuel combustion products and control means for controlling the fuel flow rate in dependence upon a heat output demand and the air flow rate in dependence upon both the fuel flow rate and the sensed aeration, the control means controlling the rate of fuel flow at one of a number of predetermined values and the air flow rate at a corresponding one of a number of differing predetermined values consistent with providing a predetermined value of aeration, characterized in that each set of predetermined values forms a geometric series characterized by a constant predetermined value of the ratio between successive predetermined values.

2. Apparatus as claimed in claim 1 in which each geometric series contains a predetermined number $N_{max}$ of terms, each term being in accordance with the following relationship:

$$Q_N = Q_1 \times R^{(N-1)}$$

where:

$Q_N$ is the gas flow rate or fan speed at the $N_{th}$ step in the predetermined series of steps, $Q_1$ is the gas flow rate or fan speed at step one in the series, R is a constant term equal to the common ratio of the geometric series, the value of R being chosen according to the resolution desired between successive steps in fuel or fan speed flow rate and being at the same value in the two series, and N is a number uniquely identifying any individual step and having a lowermost value of unity and an uppermost value of $N_{max}$, the latter being determined jointly by the chosen value of the constant R and the ratio of magnitude between the highest and lowest rates of fuel flow or fan speeds to be provided.

3. Apparatus as claimed in claim 2 in which the constant R is allocated a value of 1.025.

4. Apparatus as claimed in claim 1 in which the predetermined value of the aeration is dependent upon the flow rate of the fuel.

5. Apparatus as claimed in claim 1 in which the means for providing fuel at a variable rate comprises a modulating fuel valve having a variable opening to vary fuel flow rate.

6. Apparatus as claimed in claim 1 in which the means for supplying air at a variable rate comprises a variable speed fan.

7. Apparatus as claimed in claim 1 in which the means for sensing aeration comprises a sensor for sensing the oxygen content of the fuel combustion products and for providing a signal representative of the oxygen content.

8. Apparatus as claimed in claim 1 in which the predetermined value of fan speed associated with any predetermined value of fuel gas flow rate is automatically variable to maintain the rate of air flow and the rate of gas flow at, or substantially at, an intended ratio, should the resistance to flow or the performance of the fan alter.

9. Apparatus as claimed in claim 1 in which the predetermined value of fan speed associated with any predetermined value of fuel gas flow rate is preadjustable according to an expected degree of variation in the properties of the fuel gas to minimize the change in the aeration of the fuel/air mixture should the expected variation in fuel gas properties occur.

10. Apparatus as claimed in claim 1 in which the value of the fan speed is preadjustable by means of a predetermined operating program.

* * * * *